United States Patent [19]

Pratt

[11] Patent Number: 4,674,779

[45] Date of Patent: Jun. 23, 1987

[54] ADJUSTABLE LOCK FOR SLIDING CLOSURES

[76] Inventor: William M. Pratt, 2803 NE. 65th Ave., Vancouver, Wash. 98661

[21] Appl. No.: 731,588

[22] Filed: May 6, 1985

Related U.S. Application Data

[63] Continuation-in-part of Ser. No. 491,540, May 4, 1983, abandoned.

[51] Int. Cl.[4] ..... E05C 17/32

[52] U.S. Cl. ..... 292/263; 292/DIG. 46

[58] Field of Search ..... 292/262, 263, 338, 339, 292/DIG. 46, DIG. 31; 70/94

[56] References Cited

U.S. PATENT DOCUMENTS

| | | | |
|---|---|---|---|
| 2,284,003 | 5/1942 | Luppert | 292/263 X |
| 3,486,781 | 12/1969 | Crum | 292/262 |
| 3,608,940 | 9/1971 | Mueller | 292/338 X |
| 3,698,754 | 10/1972 | Means | 292/DIG. 46 X |
| 4,070,049 | 1/1978 | Brewer | 70/94 X |
| 4,295,676 | 10/1981 | Smith | 292/DIG. 46 X |

*Primary Examiner*—Richard E. Moore

*Attorney, Agent, or Firm*—Eugene D. Farley

[57] ABSTRACT

An adjustable lock for sliding patio doors and other closures comprises first and second rigid, bar-shaped links arranged end to end and pivotally interconnected. The outer end of one link is pivotally connected to a bracket which in turn is mounted on a structural member. The outer end of the other link is pivotally connected to a second bracket which in turn is mounted on a sliding closure, for example a sliding patio door. The links are adjustable between a straight-line, locked position, and a jackknifed, unlocked position.

Means are provided for adjusting the length of one of the links to tension the assembly and to adapt it to openings of various dimensions as well as to provide, when desired, a partially open position of the closure while still in locked condition for ventilating purposes and also to permit the entry of pets.

4 Claims, 8 Drawing Figures

ADJUSTABLE LOCK FOR SLIDING CLOSURES

This application is a continuation-in-part of the patent application of William M. Pratt, Ser. No. 491,540, filed May 4, 1983 for Integral Door Lock, now abandoned.

BACKGROUND AND GENERAL STATEMENT OF THE INVENTION

This invention relates to a lock for sliding closures. It pertains particularly to an adjustable lock for sliding patio doors and windows. It is described herein with particular reference to its application to sliding patio doors, although no limitation thereby is intended.

It is the general purpose of the present invention to provide a lock for sliding closures which is simple in construction and economical to manufacture and to maintain, which provides a strong and positive lock, and which is universally applicable to various categories of sliding closures, in particular to sliding patio doors, i.e. to "inside sliders", "outside sliders", and "double sliders".

It is a particular feature of the invention that the lock described herein by one simple, positive adjustment may be made within limits to fit openings of varying dimensions, and by another simple, positive adjustment may be made to provide a partial opening of the closure while still in locked condition. The latter feature is of particular interest, since in the case of sliding patio doors it gives the doors a ventilating capacity and also provides for the entry of pets while maintaining the door in a positively locked condition in which it is protected from tampering from the outside.

It is another particular advantage of the invention that in its use on patio doors it may be adjusted to an unlocked position permitting free entrance and exit, i.e. freely sliding movement of the door, without requiring unlocking of the door each time it is used.

The foregoing and other purposes of the invention are achieved by the provision of a lock for sliding closures comprising first and second rigid, bar-shaped links. Pivotal connecting means interconnect the inner ends of the links for adjustment between a straight line, locked, closed closure position, and a jackknifed, unlocked, open closure position.

Link stop means on the inner ends of the links releasably maintain them in their straight line position.

Bracket means mount the outer ends of the links, one to a structural member and the other to the sliding closure.

One of the links comprises substantially aligned first and second segments arranged for partial opening of the door in locked position. An elongated slide of predetermined length is mounted for longitudinal sliding movement on one of the segments. The other segment comprises a shaft connected at one of its ends to the slide and at the other of its ends to the bracket.

A latch is mounted on the first segment. It engages and maintains the slide releasably in the locked position of the lock.

Slide stop means on the slide arrests its sliding movement in a second position, thereby determining the extent of elongation of the second link and hence the degree of opening of the closure.

THE DRAWINGS

In the drawings:

FIG. 1 is a schematic view illustrating the application of the sliding closure lock of my invention to a sliding patio door, FIG. 2 is a longitudinal sectional view of the lock jackknifed in the open position of the door, FIG. 3 is a side elevation of the lock in the closed, locked condition of the door, FIG. 4 is a top plan view of the lock in the closed, locked condition of the door, FIG. 5 is a detail, fragmentary, plan view of the lock illustrating the manner of its attachment to the sliding door, FIG. 6 is a longitudinal section in elevation of the lock in its fully extended, locked condition, FIG. 7 is a longitudinal section in side elevation similar to FIG. 6, illustrating the lock still in its locked condition but shortened to provide a partial closure opening, and FIG. 8 is a bottom plan view of the lock in its fully extended, locked condition.

DESCRIPTION OF A SPECIFIC EMBODIMENT OF THE INVENTION

Figure 1:
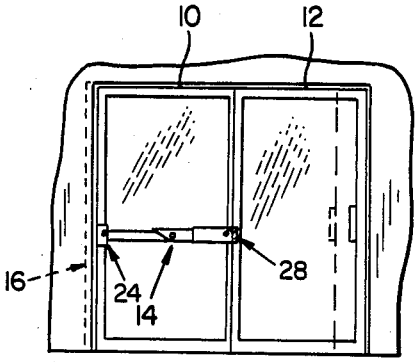

FIG. 1 illustrates the application of the lock of my invention to a specific closure, i.e. to a conventional sliding patio door. 10 Represents a fixed panel and 12 a sliding panel which slides into lapped relation with the fixed panel on a track, not shown. The lock, indicated generally at 14 is connected at one of its ends to a stud or other structural member 16 and at the other of its ends to the frame of sliding panel 12.

Figure 3:
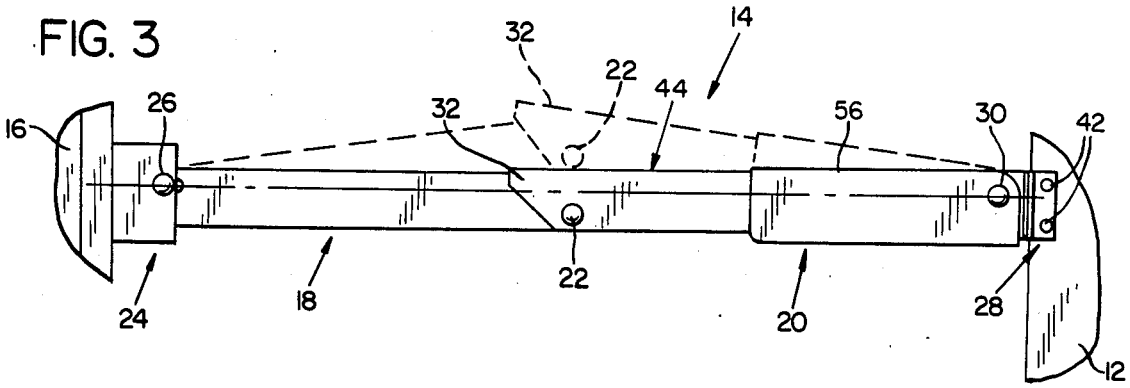
Figure 4:
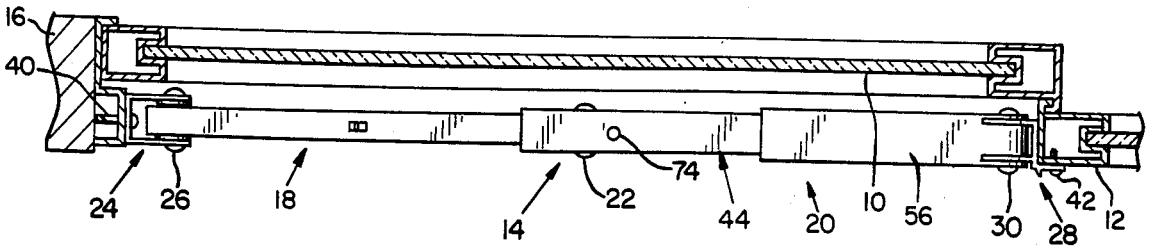

As seen in FIGS. 3 and 4, lock 14 comprises a first rigid link indicated generally at 18, and a second rigid link, indicated generally at 20. The inner ends of the two links are pivotally interconnected by means of a pivot pin 22.

The outer end of link 18 is pivotally connected by means of pivot pin 26 to a bracket indicated generally at 24. The outer end of link 20 is pivotally connected by means of a pivot pin 30 to a bracket indicated generally at 28.

It is to be noted (FIG. 3) that pins 26, 30, lie in a higher horizontal plane than does pin 22. As a result, the position of FIG. 3 is an overcenter position of the lock. This makes it impossible to open sliding panel 12 through the exertion of a thrusting motion endwise against the lock.

It is a feature of the invention that the link and bracket components all may be fabricated inexpensively from channel-shaped structural members, such as aluminum channel stock. The members of the assembly thus lie in lapped, nesting relation to each other.

The inner end 32 of link 20 accordingly may be cut away, as indicated in FIG. 3, to provide a lapping portion which in turn forms a stop, correctly aligning the two links. Simple pressure from beneath, however, will shift the links from the full line, locked, FIG. 3 position to the dashed line, unlocked, FIG. 3 position, in which it is possible to operate the sliding door from either the outside or inside, without unlocking it with each passage. This is a great convenience, especially to persons located outside the door.

Figure 6:
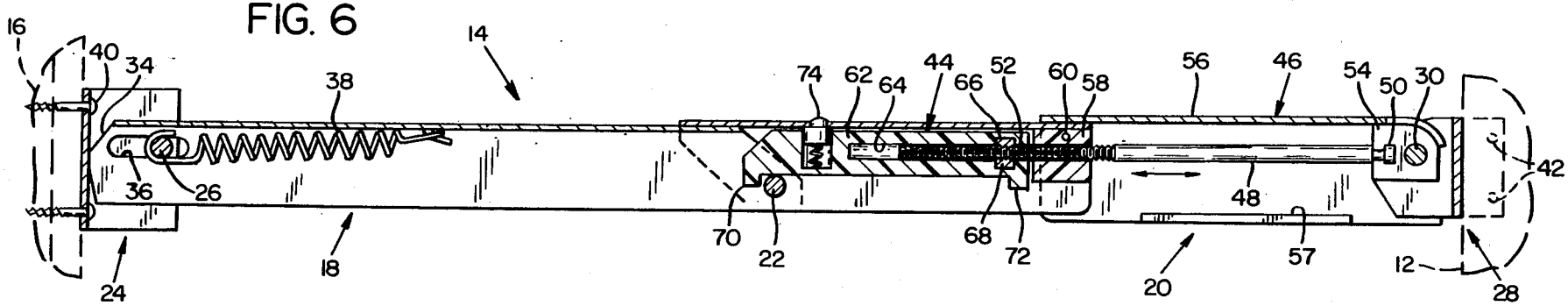

To afford clearance during operation of the lock, the outer end of channel shaped link 18 is formed with a cut away corner 34, FIG. 6.

To maintain link 18 in proper working relation to link 20, opposite aligned slots 36 are provided in the side pieces of the link. These receive pivot pin 26. A spring 38 interconnects the pin and the central portion of link 18. It maintains link 18 in proper working relation to link 20 during operation of the lock.

Bracket 24 may be affixed to structural member 16 by any suitable means, as by means of double-surfaced adhesive tape or, as illustrated, by means of screws 40.

Bracket 28 is affixed to sliding door 12 by means of screws 42.

Link 20 is comprised of two segments, an inner segment 44 and an outer segment 46.

Outer segment 46 comprises a tensioning and adjusting shaft 48, the outer end of which is formed with a retainer 50 and the inner end of which is provided with a threaded section 52.

Bracket 28 houses a bearing block 54 in which shaft 48 freely rotates. This member of the assembly preferably is made of Teflon, Nylon or other suitable plastic. It is supported by pivot pin 30. In turn, it supports the outer end of shaft 48.

The outer end of a pivoting cover 56 also is supported on pivot pin 30. The cover, like the other exterior members of the assembly, is a channel shaped member, the inner end of which laps the channel member next adjacent, i.e. segment 44. Its longitudinal margins are bent inwardly to form flanges 57 dimensioned to engage the edges of inner segment 44 when outer segment 46 is in its telescoped position of FIG. 7. This locks the assembly and prevents an interloper from reaching through the partially open door, lifting cover 56, and tampering with the lock from the outside.

Inner segment 44 of link 20 includes a guide-and-support block 58, maintained in position by a pin 60. Like bearing block 54, guide block 58 preferably is made from Teflon, Nylon or other suitable plastic material. It is provided with a longitudinal bore which receives the inner end 52 of shaft 48.

Figure 7:
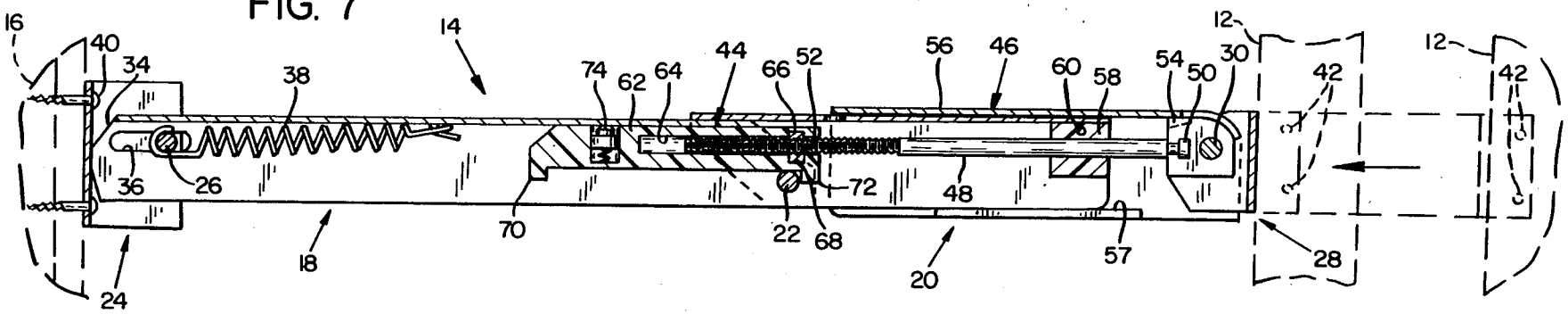
Figure 8:
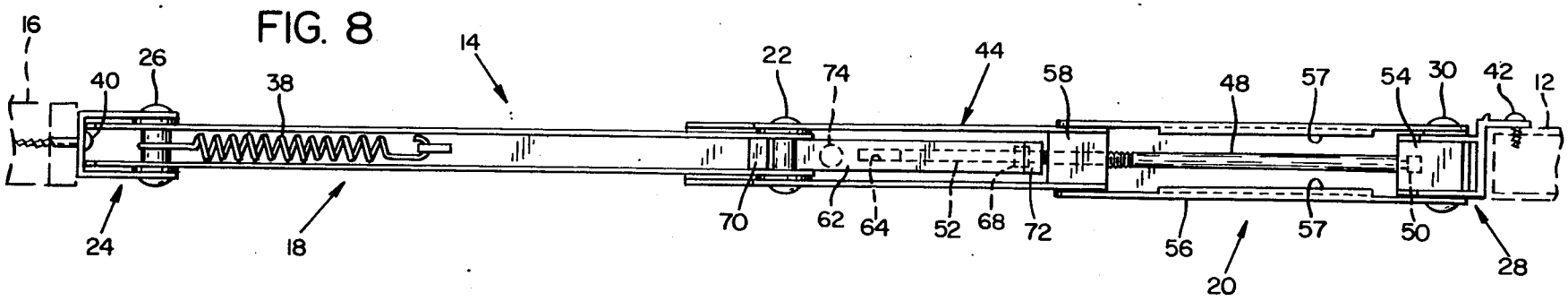

Shaft 48 provides means for adjusting the overall length of the lock to make it fit, within limits, a particular opening. The adjustment is accomplished merely by lifting up cover 56 and turning shaft 48. This results in extension or retraction of the shaft as indicated by the arrows of FIG. 7.

Extension of the shaft also results in tensioning the lock by exerting an endwise, thrusting pressure against stud 16 and the frame of sliding panel 12.

Inner segment 44 of link 20 further includes a slide 62 which in effect is a rigid extension of shaft 48. Its purpose is to make possible the provision of a partial door opening while the door is still in its locked condition, in order to permit ventilation, the entry of pets, etc.

Slide 62 also preferably is fabricated from a suitable plastic such as Teflon or Nylon. It is formed with a longitudinal bore 64 of sufficient dimensions to permit full axial movement of the end of shaft 48.

Bore 64 is formed with an enlargement or cavity 66 of sufficient dimension to receive a nut 68. The nut is held captive within the cavity and receives in threaded engagement the threaded end of shaft 48.

The undersurface of slide 62 is formed with a first or inner projection 70 and a second or outer projection 72. These are arranged in operative relationship to pivot pin 22 and provide stops for limiting the travel of the slide, and hence the opening of the door, to a predetermined distance.

Latch means are provided for releasably latching slide 62 in the fully extended, closed and locked position of the door.

As illustrated in FIGS. 6 and 7, the latch means employed comprises a spring pressed detent 74 mounted in slide 62 and extending outwardly through an opening in the web of channel 44. Upon depressing the detent and applying force to the door in the door-opening direction, the door will move until stop 72 contacts pin 22 The door now will remain partially open a distance determined by the length of travel of the slide. Fully closing the door results in travel of the slide in the reverse direction until detent 74 pops into the opening in which it is received, stop 70 serving as a back-up, especially during assembly of the unit.

Operation

The operation of the herein described sliding closure lock is as follows:

When the lock is in its straight line, fully extended position of FIGS. 3 and 6, the door is closed and securely locked. It is maintained in this condition by the thrusting force established by forcing links 18, 20 to their overcenter position against the resistance offered by structural members 12, 16. The desired degree of tension is established originally, and maintained, by adjustment of shaft 48.

Figure 2:
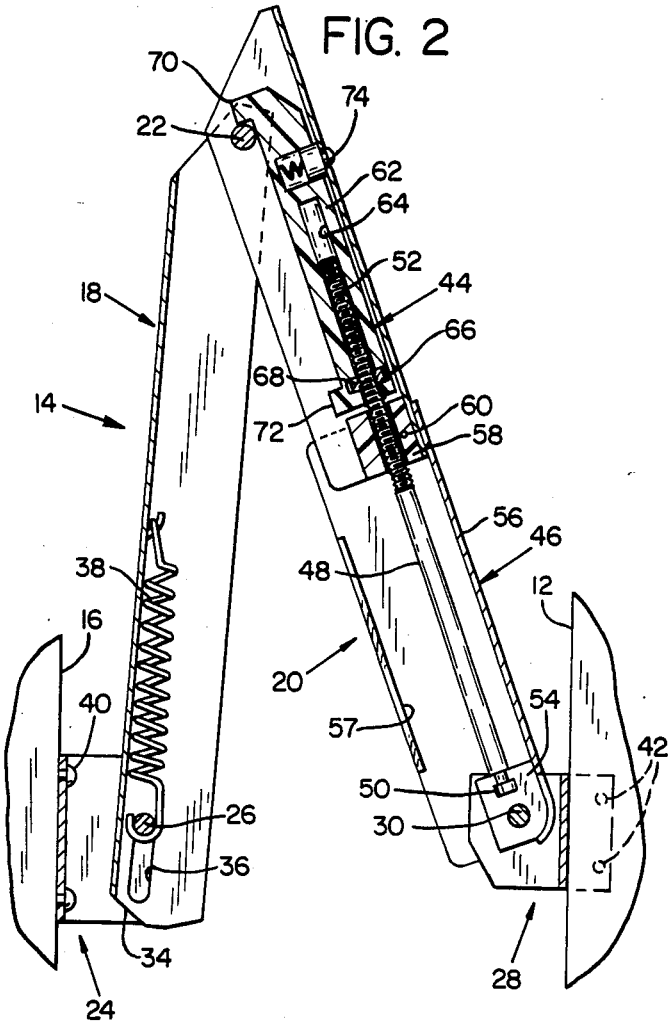
Figure 5:
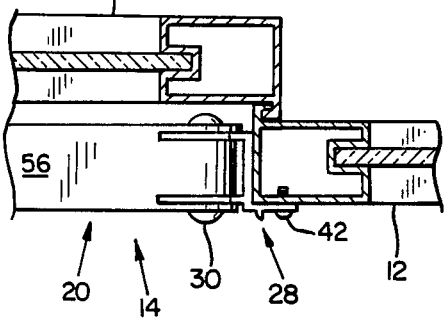

To unlock the door and open it, pressure is applied to the underside of the lock in the area of pin 22. This first adjusts the position of the component links to the partially jackknifed, dashed line position of FIG. 3. This is the position of the lock during normal use of the door, in which the door may be opened from either side with equal facility. Opening the door shifts links 18, 20 to their fully jackknifed position of FIG. 2. This motion is facilitated by the provision of slots 36 in the side pieces of link 18, in which pin 26 works, particularly when link 20 has been extended or retracted by operation of shaft 48 to fit a particular opening, thereby making the two links 18 and 20 of different length and unsymmetrical.

If a partial opening of the door is desired, detent 74 is depressed and opening force applied to the door. This moves shaft 48 and associated slide 62 inwardly from the fully extended position of FIG. 6 to the retracted position of FIG. 7. The extent of the opening is determined by the working surface of the slide present between stop 72 and detent 74.

The door thus is fully locked in its partially open position. It can be returned to its fully locked, completely closed condition simply by shutting it, whereupon the slide moves in the reverse direction until detent 74 engages its associated recess.

Running adjustment of the overall length of the lock to conform to original installation requirements, or to adjust for building settling and establish the desired tension in links 18, 20 can be achieved by lifting cover 56 and turning shaft 48 manually or with a wrench, thereby telescoping together or extending the segments 44 or 46 which comprise link 20, and shortening or lengthening the overall length of the link correspondingly. Flanges 57 on the cover prevent tampering with the lock by an interpolar located outside the door when the door is in its locked, partially open, venting position of FIG. 7.

Having thus described my invention in preferred embodiments, I claim:

1. In combination with a sliding closure, a lack comprising:

(a) first and second rigid links each having an inner end and an outer end, (b) pivot means interconnecting the inner ends of the links for adjustment of the links between a straight line, locked, closed closure position adjacent the sliding closure and a jackknifed, unlocked open closure position adjacent the sliding closure, (c) link stop means on the inner ends of the links for releasably maintaining the links in their straight line position, (d) first bracket means for mounting the outer end of the first link to a structural member, (e) first pivotal connecting means pivotally connecting the first link to the first bracket means, wherein the first pivotal connectng means comprises a pin secured to the first bracket means and a longitudinal slot in the first link and including spring means interconnecting the first link, central thereof, and the first bracket means to correctly position the first link relative to the second link and insure proper positioning of the inner segment of the second link, (f) second bracket means for mounting the outer end of the second link to the sliding closure, (g) second pivotal connecting means for pivotally connecting the second link to the second bracket means, (h) the second link comprising substantially aligned inner and outer segments arranged for partial opening of the sliding closure while retaining its locked condition, (i) the inner segment and first link comprising nested, lapped, channel members pivotally interconnected by said pivot means, (j) an elongated slide of predetermined length mounted for longitudinal movement in the inner segment, (k) the outer segment comprising a shaft connected at one of its ends to the slide and at the other of its ends to the second bracket means, (l) latch means releasably interengaging the slide and the inner segment for releasably latching the slide to the inner segment in one position of the slide, and (m) slide stop means on the slide for arresting its sliding movement in a second position, thereby determining the extent of elongation of the second link and hence the degree of opening of the sliding closure.

2. A lock for a sliding closure, comprising:

(a) first and second rigid links each having an inner end and an outer end, (b) pivot means interconnecting the inner ends of the links for adjustment of the links between a straight line, locked, closed closure position and a jackknifed, unlocked, open closure position, (c) link stop means on the inner ends of the links for releasably maintaining the links in their straight line position, (d) first bracket means for mounting the outer end of the first link to a structural member, (e) first pivotal connecting means pivotally connecting the first link to the first bracket means, (f) second bracket means for mounting the outer end of the second link to the closure, (g) second pivotal connecting means for pivotally connecting the second link to the second bracket means, (h) the second link comprising substantially aligned inner and outer segments arranged for partial opening of the closure while retaining its locked condition, (i) the inner segment and first link comprising nested, lapped, channel members pivotally interconnected by said pivot means, (j) an elongated slide of predetermined length mounted for longitudinal movement in the inner segment, (k) the outer segment comprising a rod threaded at one of its ends into the slide and at the outer of its ends to the second bracket means for adjustment of the overall lock length, (l) a cover for the rod, channel shaped in cross section and lapping in the channel shaped inner segment of the second link, (m) pivotal mounting means mounting the outer end of the cover to the second bracket means, (n) inwardly directed flanges on the longitudinal margins of the cover dimensioned to engage the inner segment upon partial opening of the closure, and thus to prevent lifting of the cover and tampering with the lock by an unauthorized person positioned outside the closure;

(o) latch means mounted on the inner segment for releasably engaging the slide in one position thereof, and (p) slide stop means on the slide for arresting its sliding movement in a second position, thereby determining the extent of elongation of the second link and hence the degree of opening of the closure.

3. A lock for a sliding closure, comprising:

(a) first and second rigid links each having an inner end and an outer end, (b) pivot means interconnecting the inner ends of the links for adjustment of the links between a straight line, locked, closed closure position and a jackknifed, unlocked, open closure position, (c) link stop means on the inner ends of the links for releasably maintaining the links in their straight line position, (d) first bracket means for mounting the outer end of the first link to a structural member, (e) first pivotal connecting means including pin and slot means pivotally connecting the first link to the first bracket means, and spring means interconnecting the first link, centrally thereof, and the first bracket means to correctly position the first link relative to the second link and insure proper positioning of the inner segment of the second link, (f) second bracket means for mounting the outer end of the second link to the closure, (g) second pivotal connecting means for pivotally connecting the second link to the second bracket means, (h) the second link comprising substantially aligned inner and outer segments arranged for partial opening of the door while retaining its locked condition.

(i) the inner segment and first link comprising nested, lapped, channel members pivotally interconnected by said pivot means, (j) an elongated slide of predetermined length mounted for longitudinal movement in the inner segment, (k) the outer segment comprising a shaft connected at one of it sends to the slide and at the other of its ends to the second bracket means;

(l) latch means mounted on the inner segment for releasably engaging the slide in one position thereof, and (m) slide stop means on the slide for arresting its sliding movement in a second position, thereby determining the extent of elongation of the second link and hence the degree of opening of the closure.

4. A lock for a sliding closure, comprising:

(a) first and second rigid links each having an inner end and an outer end, (b) pivot means interconnecting the inner ends of the links for adjustment of the links between a straight line, locked, closed closure position adjacent the sliding closure and a jackknifed, unlocked, open closure position adjacent the sliding closure, (c) link stop means on the inner ends of the links for releasably maintaining the links in their straight line position, (d) first bracket means for mounting the outer end of the first link to a structrual member, (e) first pivotal connecting means pivotally connecting the first link to the first bracket means, the first pivotal connecting means comprising a pin secured to the first bracket means and a longitudinal slot in the first link and including spring means interconnecting the first link, centrally thereof, and the first bracket means to correctly position the first link relative to the second link and ensure proper positioning of the inner segment of the second link, (f) second bracket means for mounting the outer end of the second link to the sliding closure, (g) second pivotal connecting means for pivotally connecting the second link to the second bracket means, (h) the second link comprising substantially aligned inner and outer segments arranged for partial opening of the sliding closure while retaining its locked condition, (i) the inner segment and first link comprising nested, lapped, channel members pivotally interconnected by said pivot means, (j) an elongated slide of predetermined length mounted for longitudinal movement in the inner segment, (k) the outer segment comprising a shaft connected at one of its ends to the slide and at the other of its ends to the second bracket means, (l) latch means releasably interengaging the slide and the inner segment for releasably latching the slide to the inner segment in one position of the slide, and (m) slide stop means on the slide for arresting its sliding movement in a second position, thereby determining the extent of elongation of the second link and hence the degree of opening of the sliding closure.

* * * * *